US006032335A

United States Patent [19]

Harzenmoser et al.

[11] Patent Number: 6,032,335

[45] Date of Patent: Mar. 7, 2000

[54] APPARATUS FOR DRAWING A FIBROUS STRAND INTO AN ELEMENT OF A TEXTILE MACHINE

[75] Inventors: Isidor Harzenmoser, Wallisellen; Hans Baumann, Uster, both of Switzerland

[73] Assignee: Zellweger Luwa AG, Switzerland

[21] Appl. No.: 09/181,855

[22] Filed: Oct. 29, 1998

[30] Foreign Application Priority Data

Oct. 30, 1997 [CH] Switzerland ..... 2519/97

[51] Int. Cl.[7] ..... D04H 11/00

[52] U.S. Cl. ..... 19/157; 19/150; 28/271

[58] Field of Search ..... 19/65 R, 66 R, 19/150, 157, 236, 239, 240; 28/271, 272, 273, 274, 275, 276, 254; 226/97.1, 97.2, 97.3, 97.4

[56] References Cited

U.S. PATENT DOCUMENTS

| | | | |
|---|---|---|---|
| 2,884,756 | 5/1959 | Head | 28/271 |
| 3,710,460 | 1/1973 | Segraves | 28/271 |
| 4,134,191 | 1/1979 | Kim et al. | 28/271 |
| 4,251,904 | 2/1981 | Sano et al. | 28/271 |
| 4,763,387 | 8/1988 | Bothner | 19/157 |
| 4,864,853 | 9/1989 | Grunder et al. | 19/240 |
| 5,666,698 | 9/1997 | Nauthe et al. | 19/157 |
| 5,680,678 | 10/1997 | Nauthe et al. | 19/157 |
| 5,689,856 | 11/1997 | Nauthe et al. | 19/157 |
| 5,709,011 | 1/1998 | Baechler et al. | 19/239 |
| 5,761,773 | 6/1998 | Nauthe et al. | 19/157 |
| 5,815,887 | 10/1998 | Nauthe et al. | 19/157 |

FOREIGN PATENT DOCUMENTS

| | | |
|---|---|---|
| 0 544 425 | 6/1993 | European Pat. Off. . |
| 0 736 618 | 10/1996 | European Pat. Off. . |
| 0 736 619 | 10/1996 | European Pat. Off. . |
| 2 597 119 | 10/1987 | France . |
| 41 24 652 | 3/1992 | Germany . |

*Primary Examiner*—John J. Calvert
*Assistant Examiner*—Gary L. Welch
*Attorney, Agent, or Firm*—Burns, Doane, Swecker & Mathis

[57] ABSTRACT

The invention relates device for drawing an elongated textile intermediate product (2), such as a staple fiber fleece or sliver, into a receiving element (3) of a textile machine station. In order to be able to take in, transport onwards and twist elongated textile intermediate products, there is to be provided a guide (1) for the intermediate product. This has a guide face (13) and nozzles (7, 8) for injecting a fluid, e.g. compressed air, along axes (10, 11) which are inclined in relation to the axis (12) of the guide face. The exit apertures of the nozzles are at a distance from the intermediate product.

17 Claims, 1 Drawing Sheet

APPARATUS FOR DRAWING A FIBROUS STRAND INTO AN ELEMENT OF A TEXTILE MACHINE

FIELD OF THE INVENTION

The invention relates to apparatus for drawing an elongated textile intermediate product such as a staple fiber fleece or sliver into an element of a textile machine for processing the fibrous intermediate product. More particularly, the invention is concerned with apparatus in which air jets are directed into a passageway in a manner to draw a sliver into the passageway in a beneficial manner.

BACKGROUND OF THE INVENTION

One typical type of textile machine to which the invention relates is e.g. a drawing frame or drafting apparatus. The exit portion of the draw frame often is formed by a pair of rollers which deliver its product from the drafting region. At this stage, the fiber material may be in the form of a thin and relatively wide fleece which subsequently enters a hopper or funnel (having a cone shaped inner face) which converts the fleece into a sliver or band having a more or less circular cross-section. Downstream of the funnel, the sliver is taken up by a pair of calender-rollers which draw the sliver through the funnel and deliver it to downstream equipment.

Sometimes the hoppers or funnels are also equipped with a measuring device such as disclosed in U.S. Pat. No. 4,864,853 which leads the sliver onto a pair of calender-rollers.

The textile machine into which the textile intermediate product may be drawn-in can also be a known open-end spinning machine. The spinbox of such a machine usually has an entry portion with a pair of take-up rollers into which a sliver has to be introduced when spinning operations begin. DE 41 24 652 especially relates to a process designed for introducing the fibrous band automatically into an open-end spinning machine. In the device for performing the process of DE 41 24 652, the spun band is introduced into a torsion nozzle by a gripper. The torsion nozzle has a funnel-shaped aperture via which the gripper introduces the prepared end of the spun band into the torsion nozzle, where it is wetted, twisted and subsequently also dried by a rotating air current. The band is then picked up by a feeding cylinder.

A disadvantage of this known device can be seen in the fact that the band has to be supplied by a gripper. Although a certain suction action is produced in the swirl nozzle in the longitudinal direction of the spun band, such action is not sufficient to take in the spun band automatically and move it forward in the swirl nozzle. This is also because the primary aim of the swirl nozzle is to twist the spun band and set it by means of liquid.

SUMMARY OF THE INVENTION

The present invention provides a device which is capable of taking in an elongated textile intermediate product such as a fleece or sliver, transporting it onwards and twisting it. This is achieved through the fact that there is interposed, upstream of the element of the textile machine, a guide for the intermediate product which has a guide face and nozzles for injecting a fluid such as air. The axes of the nozzles are inclined in relation to the axis of the guide face and are thus at a distance from the intermediate product. The injected fluid produces, in the space which is delimited by the guide face, a fluid current which drives the intermediate product forward and also takes it into the said space. The guide preferably has a guide face with a cross-section which is smaller than the cross-section of the element of the textile machine, so that an end face into which the nozzles open is provided on the guide.

The advantages achieved through the invention are to be seen particularly in the fact that a guide of this kind can be attached to various elements of a textile machine and to textile machines of any desired make. Elements of this kind may be a drafting mechanism, a measuring system, a spinning device, etc. The guide is suitable for drawing-in bands, fibrous webs, yarns and other fibrous composites.

BRIEF DESCRIPTION OF THE DRAWINGS

The invention will be explained in greater detail below with the aid of an example and with reference to the accompanying figures, in which.

DETAILED DESCRIPTION OF PREFERRED EMBODIMENTS

Figure 1:
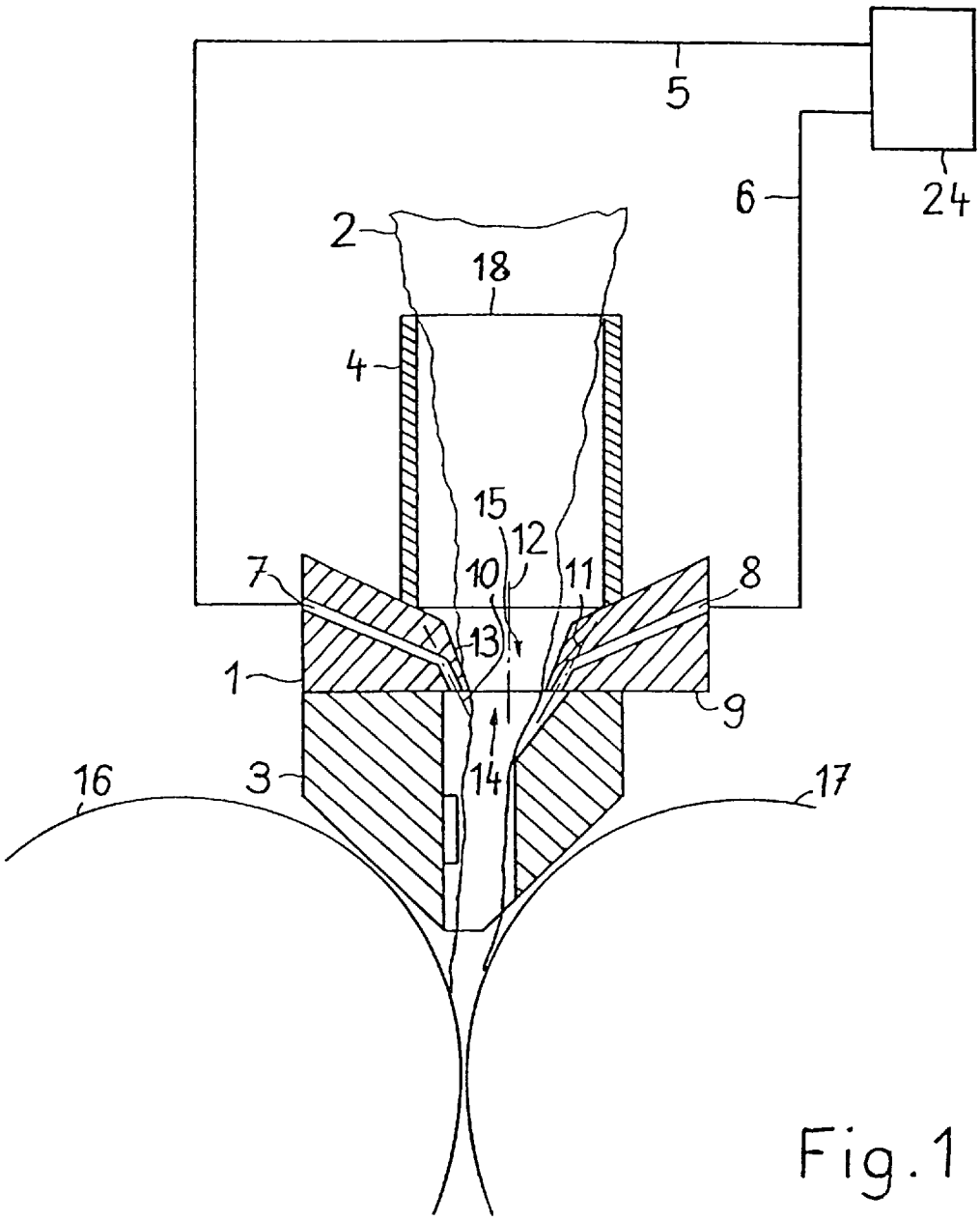
FIG. 1 shows a section through the device according to the invention.

FIG. 1 shows a guide 1 for an elongated textile intermediate product 2 which, in this case, might be a sliver or a band or a fibrous web. Also shown is an element 3 of a textile machine having an internal passageway through which the elongated fibrous strand 2 feeds as it enters a section of the machine. The illustrated embodiment of the element 3 is constructed as a measuring element for example, such as is known from U.S. Pat. No. 4,864,853, the entire disclosure of which is incorporated herein by reference. A run-in tube 4 above the guide 1 leads the intermediate product into the guide 1.

The guide 1 is connected to a controlled pressurized fluid source 24 via supply systems 5 and 6. The supply systems 5, 6 each open into a nozzle 7, 8, which nozzles open into an end face 9 of the guide 1. The end face 9 lies transversely, preferably at right angles, to the intermediate product 2 or to an axis 12. At the point where the nozzles 7, 8 open into the end face 9, the nozzles 7, 8 have axes 10, 11 which are inclined in relation to the axis 12 of a guide face 13 of the guide 1. What is brought about as a result of this is arrangement is that exit apertures of the nozzles 7, 8 are not in direct contact with the intermediate product 2.

The element 3 has a duct which has, in the upper region adjacent to the guide 1, a cross-section 14 which is greater than the open cross-section 15 of the guide 1. In this case, there are interposed, downstream of the element 3, for example measuring or driving rollers 16, 17 which are only partially represented here. The run-in tube 4 has a cross-section 18 which is greater than the cross-section 15 of the guide 1.

Figure 2:
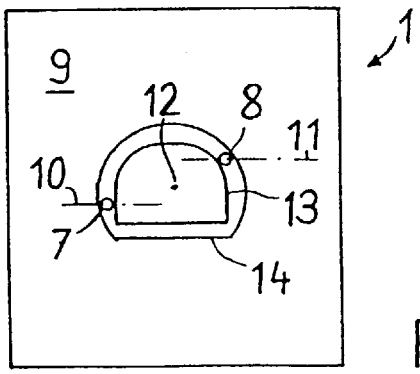
FIG. 2 shows a view of part of the device.

FIG. 2 shows the end face 9 of the guide 1 with the guide face 13, or the line of intersection of the guide face 13 with the end face 9, the nozzles 7, 8 with their axes 10, 11, the axis 12 of the guide face 13 and the open cross-section 14 of the element 3. It should be observed that the axes 10 and 11 do not intersect with the axis 12 in this case.

Under these circumstances, the way in which the device works is as follows: The textile intermediate product is guided, by means which are not indicated in greater detail here, for example manually, into the proximity of the run-in tube 4. If the product in question is a fibrous web, it is advisable to taper it at the end, for example into a point. Pressurized fluid, compressed air for example, is introduced into the nozzles 7, 8, via the supply systems 5, 6. This passes out at the end face 9 and thus generates a downwardly directed air current in the cross-section 14 in the element 3. This air current generates a negative pressure in the open cross-section 15 of the guide 1, so that air is also taken in from the run-in tube 4. There is thus produced a negative pressure at the upper end of the run-in tube 4, which sucks in the fibrous strand or band or fibrous web 2, and moves it further forwards until it passes out of the element 3 and arrives in front of the driving rollers 16, 17. The rollers 16 and 17 are driven and exert pulling force on the sliver 2 to feed it downwardly in FIG. 1.

With the nozzles 7, 8 are disposed as shown in FIG. 2, a swirl is also imparted to the air current. The intermediate product is additionally twisted by this means.

During normal operations of the textile machine, the intermediate fibrous product should be visualized as running continuously through the machine. However, breaks occur from time to time. During a start-up or after a break, an end of fibrous strand 2 must be taken into and threaded through the passage 14 extending downwardly through a central portion of the body 3 in FIG. 1. It is then that the guide 1 must produce the maximum propulsive power. Later, the supply of compressed air can be reduced. In normal production, it is sufficient to let a little compressed air through the nozzles 7, 8 in order to avoid contamination or clogging. In this case, the compressed air acts as a "lubricant" for the purpose of reducing the resistance offered by the element 3. This is particularly favorable when the element 3 is a measuring element. The compressed fluid source 24 is accordingly constructed in a controllable manner. That is to say, it can be controlled by a machine control system in such a way that the desired quantity of fluid flows in the supply systems at the desired time. It is thereby also possible to perform intermittent pulse-type cleaning of the nozzles, through the fact that a compressed air pulse is triggered at intervals in the production or periodically in some other way.

What is claimed is:

1. Apparatus for drawing an elongated fibrous intermediate product (2) into an opening in an element (3) of a textile machine, comprising a guide (1) having a guide face (13) for contacting the intermediate product and having pressurized fluid injection nozzles (7, 8), the axes (10, 11) of which are inclined in relation to the axis (12) of said guide face and which nozzles open into an end face (9) of said guide, said end face lying transversely to a direction of transport of said intermediate product through said guide.

2. Apparatus according to claim 1, wherein said guide has a guide face with a cross-section (15) which is smaller than the cross-section (14) of a duct in the element (3) in the region of the guide.

3. Apparatus according to claim 2, wherein said end face is disposed transversely to the axis (12) of the guide face and has exit apertures for the nozzles (7, 8), which are at a distance from the intermediate product.

4. Apparatus according to claim 1, wherein said nozzles each have their own supply system (5, 6) for said fluid.

5. Apparatus according to claim 1, wherein said nozzles have axes (10, 11) which do not intersect with an axis of the guide face.

6. Apparatus according to claim 4, wherein said supply system is connected to a controlled source (24) for the fluid.

7. Apparatus according to claim 1, wherein said element (3) is a measuring element.

8. Apparatus according to claim 1, additionally comprising a run-in tube (4) interposed upstream of said guide face.

9. Apparatus according to claim 5, wherein said axes of the nozzles are inclined in relation to the guide face.

10. Apparatus for drawing an elongated fibrous intermediate product into an opening of a textile machine, comprising:

a guide having a guide face for contacting the intermediate product and an end face located transverse to a direction of transport of said intermediate product through said guide, said guide having at least one fluid injection nozzle that opens into said end face, said fluid injection nozzle having an axis inclined with respect to said direction of transport of said intermediate product.

11. Apparatus according to claim 10, wherein said end face of said guide includes an opening, further comprising an element located downstream of said guide with respect to said direction of transport, said element having an opening for receiving said intermediate product from said opening of said guide, said opening of said guide having a cross-section less than a cross-section of said opening of said element.

12. Apparatus according to claim 10, wherein said guide includes at least two fluid injection nozzles.

13. Apparatus according to claim 12, wherein said fluid injection nozzles each have an axis that does not intersect a center axis of said guide face.

14. Apparatus according to claim 12, wherein said fluid injection nozzles each have an axis that is inclined with respect to said guide face.

15. Apparatus for drawing elongated fibrous product into a textile machine, comprising:

a guide having at least one fluid injection nozzle and a guide face for contacting fibrous product traveling through said guide, said fluid injection nozzle having an opening located so as to draw the fibrous product into said guide when fluid is injected with said nozzle, said opening of said fluid injection nozzle also being located so as to not contact the fibrous product traveling through said guide.

16. Apparatus according to claim 15, wherein said guide includes at least two fluid injection nozzles.

17. Apparatus according to claim 16, wherein said fluid injection nozzles each have an axis that does not intersect a center axis of said guide face.

* * * * *